United States Patent [19]

Allen

[11] Patent Number: 4,934,549

[45] Date of Patent: Jun. 19, 1990

[54] PORTABLE INSULATED STORAGE CHEST

[76] Inventor: Denise Allen, P.O. Box 332, Richton Park, Ill. 60471

[21] Appl. No.: 215,205

[22] Filed: Jul. 5, 1988

[51] Int. Cl.[5] ..... A45F 4/00; B65D 69/00

[52] U.S. Cl. ..... 220/4 E; 220/3.1; 220/18; 190/11; 190/12 A

[58] Field of Search ..... 220/4 B, 4 E, 18, 83, 220/334, 3.1, DIG. 9; 190/11, 12 A

[56] References Cited

U.S. PATENT DOCUMENTS

| | | | |
|---|---|---|---|
| 248,627 | 10/1881 | White | 220/334 |
| 1,444,455 | 2/1923 | Brown et al. | 190/12 A |
| 2,047,461 | 7/1936 | Doyle | 220/334 |
| 2,148,439 | 2/1939 | Crawford | 220/18 |
| 2,406,237 | 8/1946 | Milkoff | 190/11 |
| 2,548,639 | 4/1951 | Weamer | 190/12 A |
| 2,683,639 | 7/1954 | Brenny | 220/4 B |
| 2,693,258 | 11/1954 | Fleisch | 190/11 |
| 2,869,769 | 1/1959 | Robinson | 220/334 |
| 3,292,810 | 12/1966 | Schechter | 220/4 E |
| 3,310,905 | 3/1967 | Davis et al. | 220/4 B |
| 3,391,765 | 7/1968 | Baker | 220/334 |
| 3,412,888 | 11/1968 | Andrews et al. | 220/4 B |
| 3,451,580 | 6/1969 | Husby | 220/4 B |
| 3,524,564 | 8/1970 | Schurman | 220/334 |
| 3,848,766 | 11/1974 | Ganti et al. | 220/DIG. 9 |
| 4,336,883 | 6/1982 | Krug et al. . | |
| 4,488,623 | 12/1984 | Linnell, II et al. | 190/11 |
| 4,581,902 | 4/1986 | Starck et al. | 190/11 |
| 4,655,052 | 4/1987 | Garcia . | |
| 4,662,188 | 5/1987 | Hullihan . | |
| 4,673,117 | 6/1987 | Calton | 220/3.1 |
| 4,832,163 | 5/1989 | Levesque | 190/11 |

*Primary Examiner*—Stephen Marcus
*Assistant Examiner*—Stephen Castellano
*Attorney, Agent, or Firm*—Wallenstein, Wagner & Hattis, Ltd.

[57] ABSTRACT

A portable insulated storage chest is disclosed. The portable insulated storage chest comprises first and second container sections, each having a base and plurality of wall portions defining respective first and second receptacles, a hinge for pivotally joining the first section with the second section, the hinge permitting the first and second sections to move between a closed position and an open position, a first lid for removably covering the first opening and a second lid for removably covering the second opening.

2 Claims, 2 Drawing Sheets

PORTABLE INSULATED STORAGE CHEST

FIELD OF THE INVENTION

The present invention relates to a portable insulated storage chest and, more particularly, to a portable insulated storage chest operative also as a table.

BACKGROUND OF THE INVENTION

Insulated portable storage chests are quite popular for keeping food and beverages cold when one does not have access to a refrigerator, as for example, when one attends an activity such as a picnic in a park or a sporting or entertainment event. Such chests can alternatively be utilized to keep previously heated item hot. However, their utility is typically limited to such. In addition, as when one attends a bench seat type sporting or entertainment event, prior art insulated storage chests can pose a hazard as they are typically placed on the ground in front of the bench seat, dangerously hindering movement of spectators between their seats and aisles.

If one also desires a surface from which to eat at such activities, one also must bring a table or similar surface. Additionally, if one requires storage for items such as cameras, clothing, or any other items which must remain dry, a separate dry storage container would also be necessary, again an inconvenience and possible obstacle.

Further, when one is either bedridden, or simply desiring to relax on a couch, one often requires both a lap tray from which to support a meal or a beverage, as well as a container to keep cold items cold and hot items hot.

This invention is provided to solve some or all of the above problems.

SUMMARY OF THE INVENTION

It is an object of the invention to provide a portable insulated storage chest.

In accordance with the invention, the portable insulated storage chest comprises first and second container sections, each having a base and plurality of wall portions defining respective first and second receptacles, means for pivotally joining the first section with the second section, the pivotally joining means permitting the first and second sections to move between a closed position and an open position, a first lid for removably covering the first opening and a second lid for removably covering the second opening.

It is comprehended that the storage chest includes means for supporting the chest in the open position substantially parallel to a supporting surface.

It is further comprehended that the first container section be insulated.

It is still further comprehended that the second container section be a dry storage container. According to one embodiment of the invention, there is an interference fit between the second lid and the respective wall portions for preventing entry of liquid into the second container section.

It is yet further comprehended that the supporting means comprises a plurality of legs extending downwardly from each of the container sections, wherein the legs move between a first position extending downwardly from each of the container sections and a second position adjacent each of the respective container sections.

According to a preferred embodiment, one or both of the lids includes a recess directed inwardly from its respective container section for receiving a drink container, such as a can or a glass.

The invention further comprehends that the pivotally joining means includes means for releasing the first container portion from the second container portion, thereby permitting each of the container portions to be individually utilized as a table or a tray.

Other features and advantages of the present invention will be apparent from the specification taken in conjunction with the accompanying drawings.

BEST MODE FOR CARRYING OUT THE INVENTION

Figure 1:
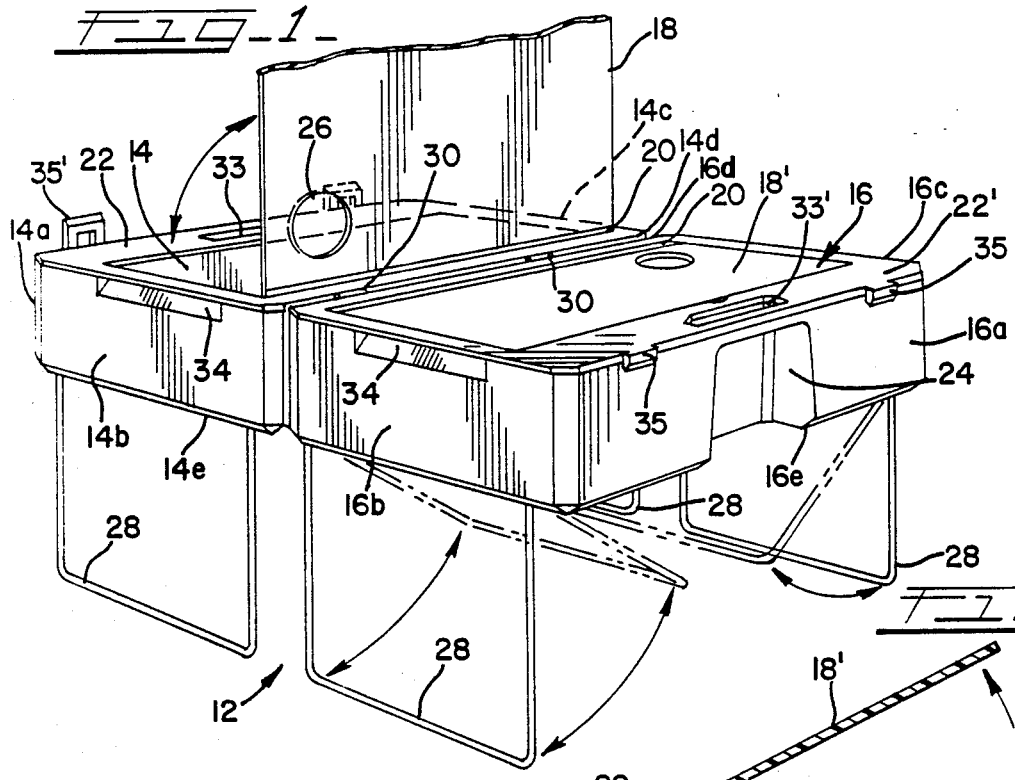
FIG. 1 is a perspective view of one embodiment of the invention.

One embodiment of my invention is illustrated in FIG. 1. A portable insulated storage chest 12 includes a first container section 14 and a second container section 16. According to this embodiment, the second container section 16 includes four walls **16*a*–16*d* and base 16*e* and is provided for dry storage of goods, such as for example, a camera, binoculars or clothing; i.e., items which do not require thermal insulation but which must remain dry. The first container section 14 includes four walls 14*a*–14*d* and a base 14*e*** and is provided for insulated storage of goods, whether they be goods needing to remain chilled or heated.

The chest 12 is preferably constructed of a molded plastic, as is well-known in the art. The first container section 14 further includes an insulating layer in each of its four walls **14*a*–14*d* as well as its base 14*e***.

The first container section 14 further includes a flat, insulated lid 18 which is pivotally joined to the rear wall **14*d* by tape 20, as illustrated in greater detail below. Other joining means could be utilized without departing from the scope of my invention. The insulated lid 18 moves between an open position, providing access to the first container section 14, and a closed position. The front wall 14*a* of the first container section 14 includes a lip 22. When the insulated lid 18 is in the closed position, it fits flush with the lip 22 to provide a flat surface which can be utilized as an eating surface, a card playing surface, or for any other use requiring a flat surface. A notch 24 is provided to facilitate opening of the lid 18. The insulated lid 18 further includes a circular recess 26** for receiving a glass or other beverage container. The lid 18 is dimensioned to provide an interference fit with the first container section 14 when, in the closed position, thereby providing good thermal insulation.

The second container section 16 also includes a lid, identified as 18', which closes flush with a lip 22' of the second container section 16 to provide a flat surface. The lid 18' is pivotally joined to the second container section 16, as by tape 20. The lid 18' is dimensioned to provide an interference fit with the second container section 16 when in the closed position to prevent entrance of liquids therein. The lid 18' of the second container section 16 further includes a notch 24 to facilitate opening thereof, as well as a circular recess 26 for receiving a beverage container, or the like.

Extending downwardly from each of the container sections 14, 16 are legs 28. The legs 28 are pivotally joined to the container sections 14, 16 and move between an extended position, as illustrated in FIG. 1, and a collapsed position. When in the extended position, the legs 28 elevate the sections 14, 16 of the chest 12 from the ground, providing a table or, when dehinged, a pair of lap trays.

As discussed in greater detail below, the first container section 14 is pivotally joined to the second container section 16 by releasable hinges 30. When the chest 12 is open, as illustrated in FIG. 1,, the first container section 14 can be separated from the second container section 16 at the releasable hinges 30. The legs 28 can be placed in their extended position, and each container section 14, 16 can be utilized as a lap tray.

The lips 22, 22' each include handles 33, 33' which align with one another when the chest 12 is closed. To facilitate lifting the container section 14, 16 when the chest is dehinged and in the open position, indented grips 34 are provided on opposing side walls of each of the first and second container sections 14 and 16.

A pair of latches, each comprising a male portion 35 and an interlocking female portion 35' are utilized to maintain the chest 12 in the closed position.

Figure 2:
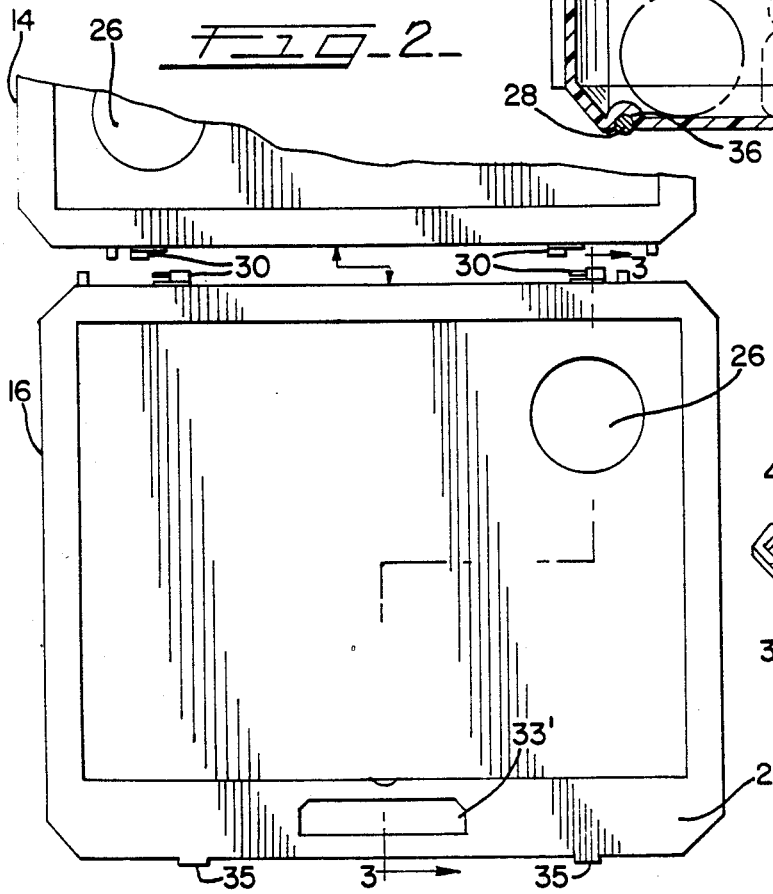
FIG. 2 is a top view of the embodiment illustrated in FIG. 1.

Referring now to FIG. 2, the releasable hinges 30 are illustrated in greater detail. As indicated above, the hinges 30 permit the first container section 14 to detach from the second container section 16, thereby providing two separate tables.

Figure 3:
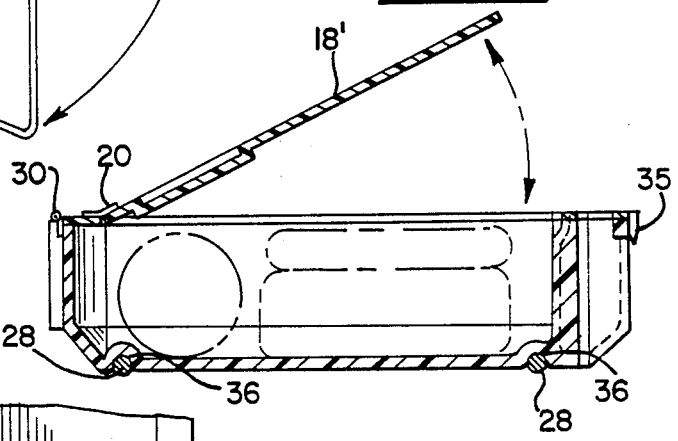
FIG. 3 is a section of the embodiment illustrated in FIG. 1 taken along line 3—3 of FIG. 2.

Referring to FIG. 3, the legs 28 are illustrated in their closed position, received by grooves 36. The grooves 36 receive the legs 28 flush with the bases **14*e*, 16*e* of the first and second container sections 14, 16**, respectively, when in the closed position.

Figure 5:
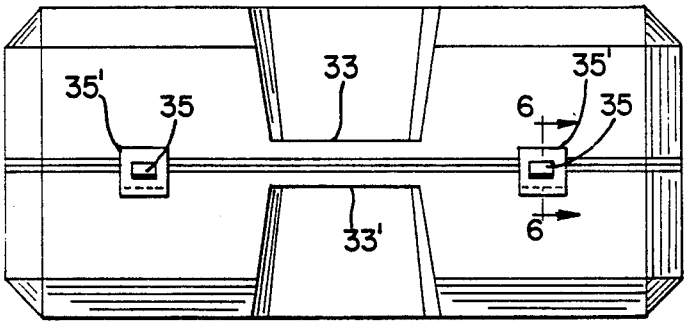
FIG. 5 is a front view of the embodiment illustrated in FIG. 2.

Referring to FIG. 5, the first and second container sections 14, 16 are illustrated in the closed position. The openings of the handles 33, 33' align with one another providing ease of carrying the chest 12.

Figure 6:
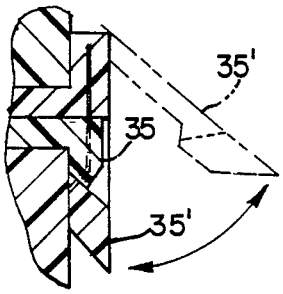
FIG. 6 is an enlarged sectional view of a latch according to the invention taken along line 6—6 of FIG. 5.

FIG. 6 illustrates the male and female latch portions 35, 35' in greater detail. The latch may be a draw latch, as distributed by Southco, Inc. of Concordville, PA.

Figure 7:
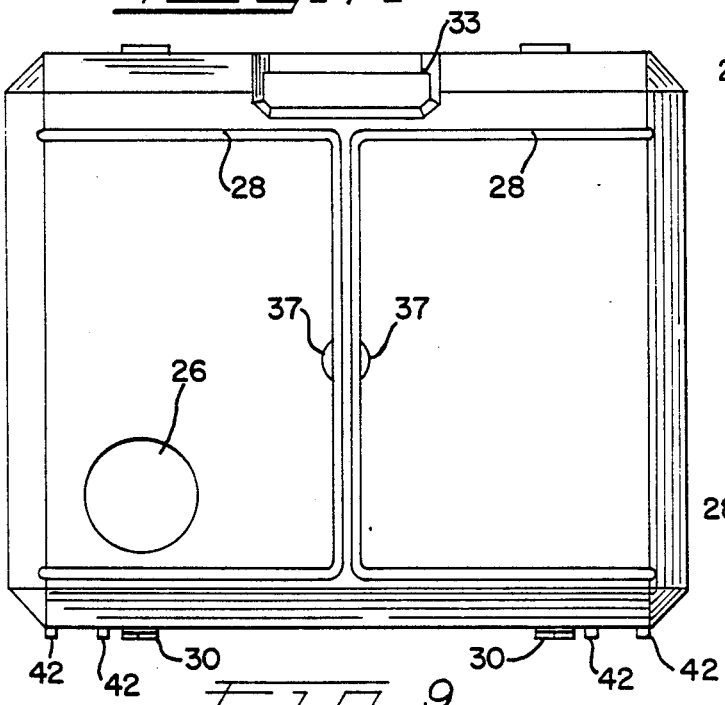
FIG. 7 is a view of one side of the embodiment illustrated in FIG. 1.
Figure 8:
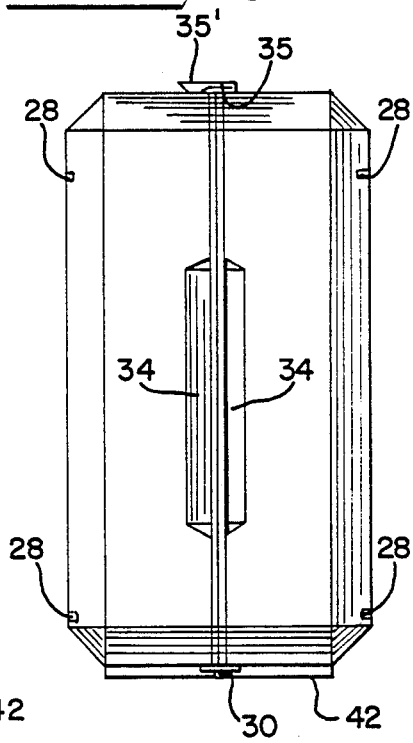
FIG. 8 is a view of another side of the embodiment illustrated in FIG. 1.
Figure 9:
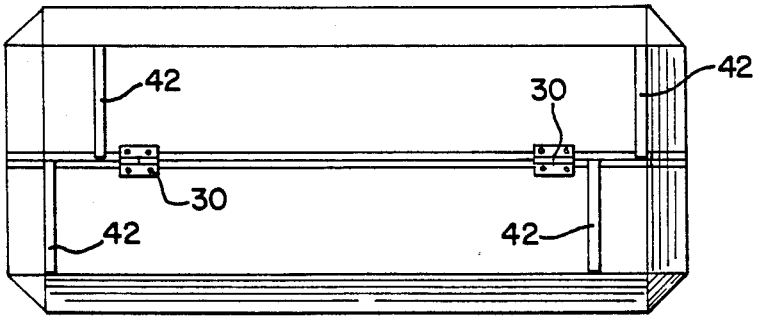
FIG. 9 is a bottom view of the embodiment illustrated in FIG. 1.

Referring to FIGS. 7–9, feet 42 extending from the storage chest 12 are provided to permit the storage chest 12 to stand vertically without interference from the hinges 30. Additionally, a circular recess 26 is provided on the outside of the container sections 14, 16 for receiving beverage containers when the chest 12 is closed. A cutaway 37, as illustrated in FIG. 7, permits access to the legs 28 for ease of opening.

Figure 4:
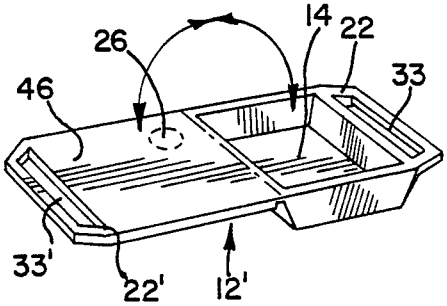
FIG. 4 is a perspective view of another embodiment of the invention.

An alternate embodiment 12' of my invention is illustrated in FIG. 4. It is contemplated that the storage chest 12' of FIG. 4 be made of an inexpensive, disposable material such as styrofoam, so that it can be thrown away after use. However, it could also be made of the same material as the first embodiment.

According to this alternate embodiment, the storage chest 12' has only a first container section 14. A top 46 is pivotally joined to a wall of the first container section 14, and the top 46 further includes a handle 33' which aligns with a handle 33 of the first container section 14 when the top 46 is closed. When in the closed position, the top 46 functions as a table and includes a recess 26, illustrated in phantom, for receiving beverage containers or the like, when closed. Although not specifically shown in FIG. 4, the storage chest 12' may include legs 28 and grips 34 as described above with reference to the first embodiment of the invention.

As is readily apparent from the above specification, my invention provides a unique container which can be used simultaneously as both an insulated container as well as a dry storage container. It further provides a raised, flat surface which can be used as either a table or a pair of lap trays for eating, writing, playing games, doing manicures, to name just a few possibilities. The container sections 14, 16 can remain hinged to provide a large surface, or they can be separated to provide two, smaller surfaces.

It will be understood that my invention may be embodied in other specific forms without departing from the spirit or central characteristics thereof. The present examples and embodiments, therefore, are to be considered in all respects as illustrative and not restrictive, and my invention is not to be limited to the details given herein.

I claim:

1. A portable insulated storage chest adaptable for use as a tray above a surface, the storage chest comprising:

first and second container sections, each having a base and a plurality of wall portions defining respective first and second receptacles, said base and plurality of wall portions of said first container section being formed of an insulating material;

means for pivotally joining said first container section with said second container section, wherein said pivotally joining means includes means for releasing said first container section from said second container section, said pivotally joining means permitting said first and second container sections to move between a closed position, wherein said first and second container sections are flush with each other, and an open position;

a first lid for removably covering said first receptacle;

a second lid for removably covering said second receptacle; and means for supporting said first and second sections in spaced relationship with said surface.

2. A portable insulated storage chest comprising:

a first container section having an insulated base and plurality of insulated wall portions defining an insulated first receptacle;

a second container section having a base and a plurality of wall portions defining a second receptacle;

means for pivotally joining said first container section with said second container section, wherein said pivotally joining means includes means for releasing said first container section from said second container section, said pivotally joining means permitting said first and second container sections to move between a closed position wherein said first and second container sections are flush with each other, and an open position;

a first insulated lid for removably covering said first receptacle;

means for providing a thermal barrier between said first lid and said respective first container section wall portions when said first lid is covering said first receptacle;

a second lid for removably covering said second receptacle;

means for providing a water barrier between said second lid and said respective second container section wall portions when said second lid is covering said second receptacle; and collapsible legs selectively extending from each of said container section bases, said legs for supporting said chest in said open position in spaced relation to a supporting surface.

* * * * *